US012551816B1

(12) United States Patent
DeBarros

(10) Patent No.: US 12,551,816 B1
(45) Date of Patent: Feb. 17, 2026

(54) FIDGET TOY

(71) Applicant: Jonathan DeBarros, Lake Hopatcong, NJ (US)

(72) Inventor: Jonathan DeBarros, Lake Hopatcong, NJ (US)

( * ) Notice: Subject to any disclaimer, the term of this patent is extended or adjusted under 35 U.S.C. 154(b) by 267 days.

(21) Appl. No.: 18/143,775

(22) Filed: May 5, 2023

(51) Int. Cl.

| | |
|---|---|
| ***A63H 1/00*** | (2019.01) |
| ***A63H 33/00*** | (2006.01) |
| ***A63H 33/26*** | (2006.01) |
| ***F41B 3/02*** | (2006.01) |

(52) U.S. Cl.
CPC ..... *A63H 33/26* (2013.01); *A63H 1/00* (2013.01); *A63H 33/00* (2013.01); *F41B 3/02* (2013.01)

(58) Field of Classification Search
CPC ... A63H 1/00; A63H 1/10; A63H 1/12; A63H 33/00; F41B 3/02
See application file for complete search history.

(56) References Cited

U.S. PATENT DOCUMENTS 2,070,414 A 2/1937 Snell
2,781,960 A * 2/1957 Dick ..... A47J 47/16 215/396
3,116,947 A 1/1964 Brownrigg
3,575,414 A * 4/1971 O'Brien ..... A63H 33/02 473/514
3,682,352 A 8/1972 Doucette
4,509,639 A * 4/1985 Thompson ..... B65D 23/0842 206/427
4,544,194 A * 10/1985 Allen ..... B65D 71/504 294/87.2
4,627,546 A 12/1986 Carranza
4,736,920 A * 4/1988 Omessi ..... A61G 9/006 5/503.1
4,934,547 A * 6/1990 Mayes ..... A61B 10/007 215/250
5,306,060 A * 4/1994 Borg ..... B65D 71/50 206/199
5,573,152 A * 11/1996 Arnold ..... B65D 23/003 224/249
6,283,346 B1 * 9/2001 Thomas ..... B65D 23/003 215/396
6,302,286 B1 * 10/2001 Witherspoon ..... A61J 11/008 215/11.1
6,467,132 B1 10/2002 Robley
6,745,802 B2 6/2004 Varga
7,861,853 B2 * 1/2011 Borg ..... B65D 71/50 294/87.28
8,007,881 B2 8/2011 Kamite
(Continued)

*Primary Examiner* — John A Ricci
(74) *Attorney, Agent, or Firm* — Michael J. Feigin, Esq.; Feigin and Fridman LLC

(57) ABSTRACT

A fidget toy, including at least one canister including an upper cover and a cylindrical body. The fidget toy further includes a tether, including an elongate central line and a pair of loops at ends of the line, at least one of the loops being disposed about the upper cover of the at least one canister. The at least one of the loops is rotatable about the at upper cover. The at least one canister further includes a lower cover, removably attached to the cylindrical body. The upper cover and/or the lower cover may be threadably attached to the cylindrical body. A magnet may be disposed within the upper cover and/or within the lower cover.

10 Claims, 6 Drawing Sheets

(56) References Cited

U.S. PATENT DOCUMENTS

| | | | | |
|---|---|---|---|---|
| 9,004,978 | B2 * | 4/2015 | Shaw | A63B 67/08 446/490 |
| 9,903,511 | B2 | 2/2018 | Vermillion | |
| D827,491 | S | 9/2018 | Halpern | |
| 10,085,543 | B2 * | 10/2018 | Breit | A45F 5/102 |
| 10,617,966 | B1 * | 4/2020 | Pena | A63H 5/00 |
| 10,888,798 | B1 * | 1/2021 | Vaca | A63H 33/00 |
| D964,476 | S | 9/2022 | DeBarros | |
| 2004/0244285 | A1 | 12/2004 | Fishman et al. | |
| 2006/0030234 | A1 | 2/2006 | Stiber et al. | |
| 2006/0255007 | A1 * | 11/2006 | Velardi | B65D 23/003 215/399 |
| 2017/0129650 | A1 | 5/2017 | Karas | |

* cited by examiner

FIDGET TOY

FIELD OF THE DISCLOSED TECHNOLOGY

The disclosed technology relates generally to a fidget toy. More specifically, the disclosed technology relates to a fidget toy allowing a user to carry out twisting, pulling, and swinging motions, between two canisters connected by an elastic band.

BACKGROUND OF THE DISCLOSED TECHNOLOGY

Most people fidget in one way or another—by tapping their legs, twirling their hair, doodling in a book, and the like. However, some people, such as people suffering from anxiety, ADD, or ADHD, may need to fidget in order to be able to function or study.

Fidget toys, often given to people to fidget with during intense periods or when concentration is required, have been shown to help reduce anxiety and stress, enhance dexterity, and improve learning abilities. However, many fidget toys are disruptive to the surrounding—for example make loud clicking noises, or are distracting to people around the user of the fidget toy.

Thus, while there are many different fidget toys, there is still room for improvement. There is a need in the art for fidget toys that move in a fluid manner, and do not make noise or disrupt the environment in which the fidget toy is being used.

SUMMARY OF THE DISCLOSED TECHNOLOGY

There is provided, in accordance with an embodiment of the disclosed technology, a fidget toy, including at least one canister including an upper cover and a cylindrical body. The fidget toy further includes a tether, including an elongate central line and a pair of loops at ends of the line, at least one of the loops being disposed about the upper cover of the at least one canister.

In some embodiments, the at least one canister comprises a single canister, and wherein both loops of the pair are disposed about the upper cover of the single canister.

In some embodiments, the at least one canister comprises a first canister having a first upper cover and a first body, and a second canister having a second upper cover and a second body. In some such embodiments, a first loop of the pair of loops is disposed about the first upper cover, and a second loop of the pair of loops is disposed about the second upper cover.

In some embodiments, the at least one of the loops is rotatable about the at upper cover.

In some embodiments, the upper cover includes a head, a neck portion, and a cylindrical engagement portion for engaging the body, and wherein the at least one of the loops is disposed about the neck portion, between the head and an upper end of the body.

In some embodiments, the at least one canister further comprises a lower cover, removably attached to the cylindrical body.

In some embodiments, the toy further includes a magnet disposed within the lower cover, and/or a magnet disposed within the upper cover.

In some embodiments, the lower cover and/or the upper cover is threadably attached to the cylindrical body.

In some embodiments, the fidget toy further includes at least one item stored within the canister.

In some embodiments, the canister comprises an electronic storage device.

In some embodiments, at least a portion of the canister comprises a measurement device.

In some embodiments, the tether is elastic, such that the toy comprises a sling-shot.

There is provided, in accordance with an embodiment of the disclosed technology, a method of constructing a toy, the method comprising obtaining a tether, including an elongate central line and a pair of loops at ends of the line, placing at least one of the loops about an upper cover, and attaching a cylindrical body to the upper cover, to form at least one canister. In some embodiments, the at least one of the loops is disposed between the upper cover and the cylindrical body, and is rotatable relative to the upper cover and relative to the cylindrical body.

In some embodiments, placing of the at least one of the loops comprises placing both loops of the pair of loops about the upper cover.

In some embodiments, the method further includes attaching a lower cover to an end of the cylindrical body.

In some embodiments, placing includes placing a first loop of the pair of loops about a first upper cover, and placing a second loop of the pair of loops about a second upper cover, and attaching includes attaching a first cylindrical body to the first upper cover and attaching a second cylindrical body to the second upper cover, to form first and second canisters.

In some embodiments, the method further includes attaching a first lower cover to an end of the first cylindrical body and attaching a second lower cover to an end of the second cylindrical body.

DETAILED DESCRIPTION OF EMBODIMENTS OF THE DISCLOSED TECHNOLOGY

A fidget toy includes at least one canister, and an elastic tether. The at least one canister includes a cylindrical body having a first end and a second end. A first cover is connectable to the first end of the cylindrical body, and a second cover a connectable to the second end of the cylindrical body. The tether is disposed between the first end of the cylindrical body and the first cover, such that the tether is rotatable about the at least one canister.

Embodiments of the disclosed technology will become clearer in view of the foregoing description of the figures.

Figure 1:
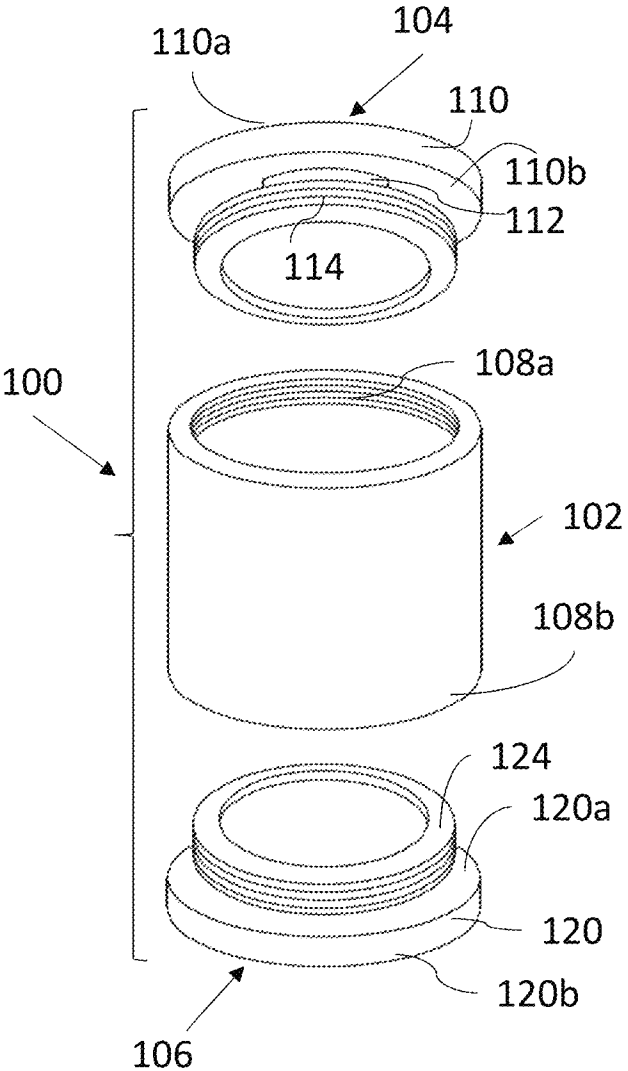
FIG. 1 is an exploded perspective view illustration of a canister forming part of a fidget toy according to an embodiment of the disclosed technology.

FIG. 1 is an exploded perspective view illustration of a canister 100 forming part of a fidget toy according to an embodiment of the disclosed technology.

Canister 100 includes a hollow body portion 102, an upper cover 104 (also termed herein the first cover), and a lower cover 106 (also termed herein the second cover).

In some embodiments, and as illustrated, hollow body portion 102 may be a cylindrical body portion. Body portion 102 includes an upper thread portion 108*a*, and a lower threaded portion 108*b*, each of which includes threading on an interior surface of body portion 102.

Figure 2A:
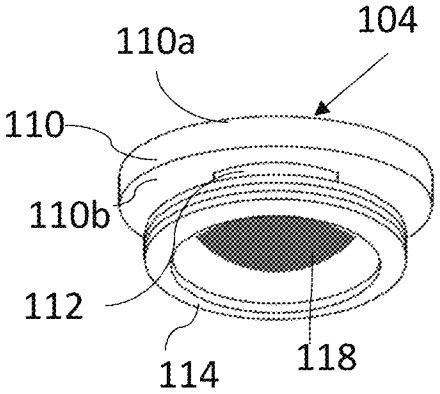
FIGS. 2A and 2B are, respectively, a perspective view illustration and a side view illustration of an upper cover of the canister of FIG. 1, according to an embodiment of the disclosed technology.
Figure 2B:
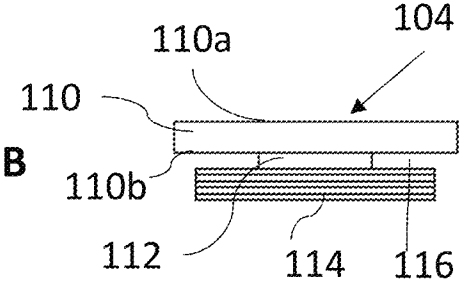

Reference is now additionally made to FIGS. 2A and 2B, which are, respectively, a perspective view illustration and a side view illustration of upper cover 104, according to embodiments of the disclosed technology. As seen, upper cover 104 includes a head 110, here shown as a flat disc having an upper surface 110*a* and a lower surface 110*b*. A cylindrical neck portion 112 extends from lower surface 110*b*, away from upper surface 110*a*. A threaded cylindrical engagement portion 114 extends from neck portion 112, away from head 110. Threading of engagement portion 114 is disposed on an external surface thereof, such that engagement portion 114 is adapted to threadably engage upper threaded portion 108*a*. The diameter of neck portion 112 is smaller than the diameters of head 110 of engagement portion 114, such that a recess 116 is formed between the head and the engagement portion. The diameter of engagement portion 114 is similar to that of the interior wall of body portion 102, to enable engagement portion 114 to be threaded within body portion 102. In some applications, the diameter of head 110 is substantially equal to the external diameter of body portion 102. In some applications, a magnet 118 may be disposed within engagement portion 114, as shown clearly in FIG. 2A.

Figure 3:
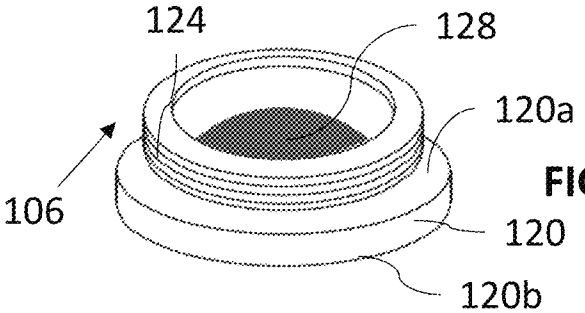
FIG. 3 is a perspective view illustration of a lower cover of the canister of FIG. 1, according to an embodiment of the disclosed technology.

Returning to FIG. 1, reference is now additionally made to FIG. 3, which is a perspective view illustration of lower cover 106, according to embodiments of the disclosed technology. As seen, upper cover 106 includes a head 120, here shown as a flat disc having an upper surface 120*a* and a lower surface 120*b*. A threaded cylindrical engagement portion 124 extends from upper surface 120*a*, away from lower surface 120*b*. Threading of engagement portion 124 is disposed on an external surface thereof, such that engagement portion 124 is adapted to threadably engage lower threaded portion 108*b*. The diameter of engagement portion 124 is similar to that of the interior wall of body portion 102, to enable engagement portion 124 to be threaded within body portion 102. In some applications, the diameter of head 120 is substantially equal to the external diameter of body portion 102. In some applications, a magnet 128 may be disposed within engagement portion 124, as shown clearly in FIG. 3.

Figure 4B:
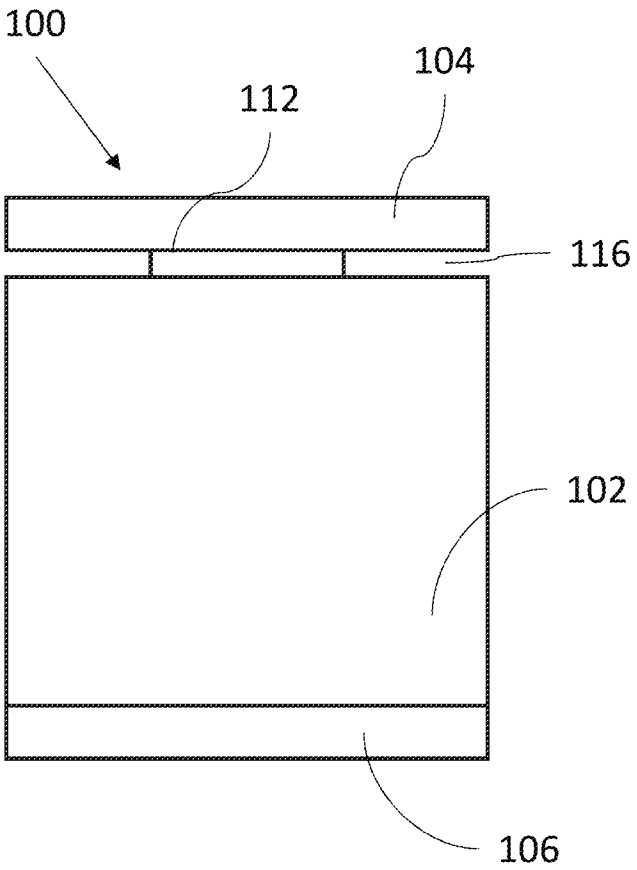
FIGS. 4A and 4B are, respectively, a perspective view illustration and a side view illustration of the canister of FIG. 1, when constructed.
Figure 4A:
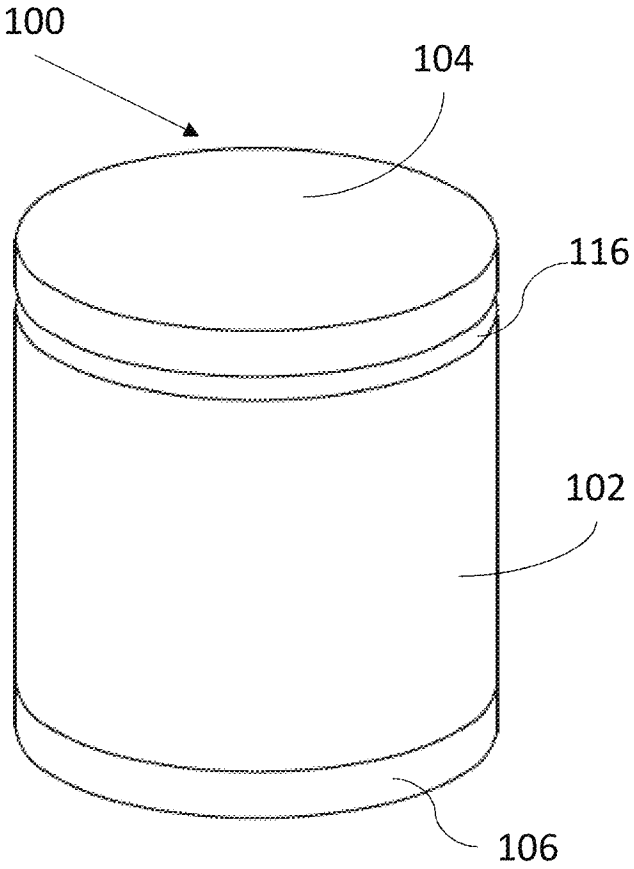

Reference is now additionally made to FIGS. 4A and 4B are, respectively, a perspective view illustration and a side view illustration of canister 100, when constructed.

As seen, canister 100 has a generally cylindrical structure, with recess 116 formed between an upper end of body portion 102 and head 110 of upper cover 104. As explained in further detail hereinbelow, recess 116 is sized to receive a tether.

In some applications, canister 100 may be filled with a filler material, which may be a solid, a fluid, a gel, or a powder.

In some applications, any one or more portions of canister 100 may be transparent. For example, body portion 102 may be transparent to show a filler material disposed within the canister.

Figure 5:
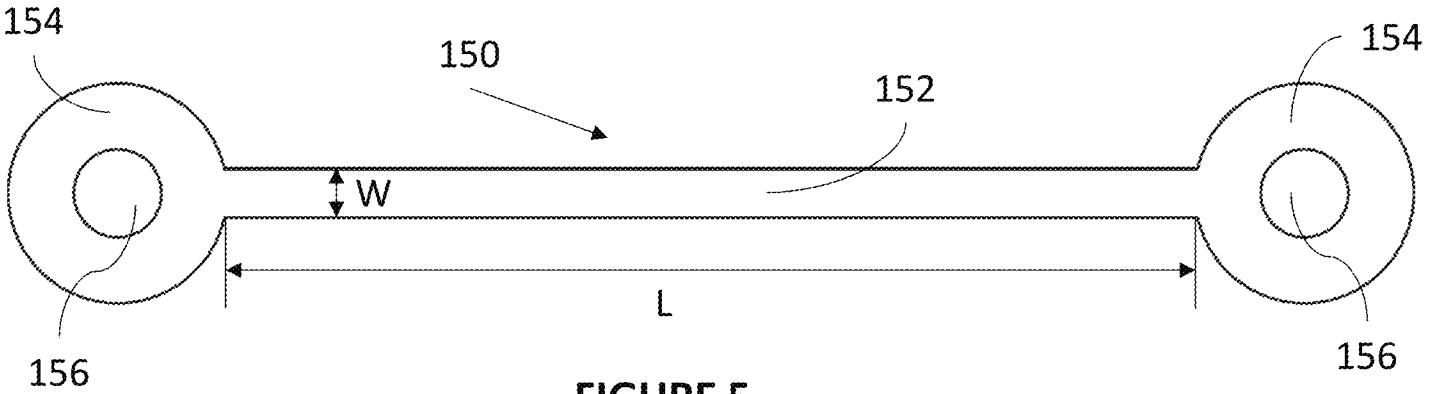
FIG. 5 is a top view illustration of a tether forming part of a fidget toy according to an embodiment of the disclosed technology.

Reference is now made to FIG. 5, which is a top view illustration of a tether 150 forming part of a fidget toy according to an embodiment of the disclosed technology. Tether 150 includes a central line 152, terminating in two loops 154. Each of loops 154 includes a central opening 156. Central openings 156 of loops 154 are sized and configured to fit around neck portion 112 of upper cover 104 of a canister 100 as described hereinabove with respect to FIGS. 1 to 4B.

Tether 150 is generally very long and thin, such that a thickness of the tether is smaller than a width W of central line 152, which is substantially smaller than a length L of the central line. For example, length L of central line 152 may be 5", width W of central line 152 may be ¼", and the thickness of tether 150 may be 1/16".

Tether 150 is formed of a flexible, elastic, durable, and tear-resistant material, such as silicone rubber. Specifically, tether is sufficiently elastic to enable central openings 156 to stretch to enable engagement portion 114 of upper cover 104 (see FIGS. 1, 2A, and 2B) to pass therethrough.

Figure 6:
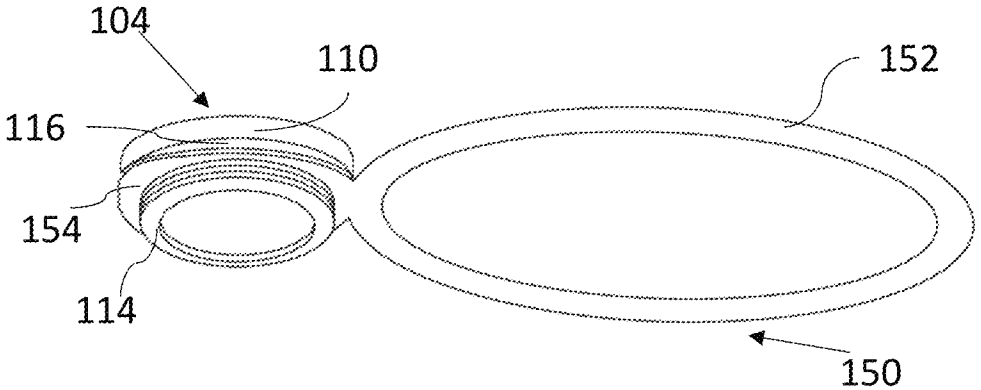
FIG. 6 is a perspective view illustration of the tether of FIG. 5, connected to an upper cover of the canister of FIG. 1, to form part of a fidget toy according to some embodiments of the disclosed technology.

FIG. 6 is a perspective view illustration of tether 150 connected to upper cover 104 of canister 100 of FIGS. 4A and 4B, to form part of a fidget toy according to some embodiments of the disclosed technology. As seen, both loops 154 of tether 150 are disposed about neck portion 112 of upper cover 104, with central line 152 being bent, or folded. In this arrangement, loops 154 of tether 150 are within recess 116. As such, tether 150 is directly attached to upper cover 104. However, in some embodiments, sizing of central openings 156 is such that the tether 150 can rotate about neck portion 112 of the upper cover, and thus can rotate relative to the upper cover. It is to be appreciated that, in order to place loops 154 around neck portion 112, the loops of the tether are stretched and manipulated so that openings 156 are sufficiently large for engagement portion 114 of the upper cover to pass through the openings. The resilience and/or elasticity of the tether ensure that, once the engagement portion passes through openings 156 and the tether is released, the tether and openings return to their original dimensions and/or configuration.

Figure 7A:
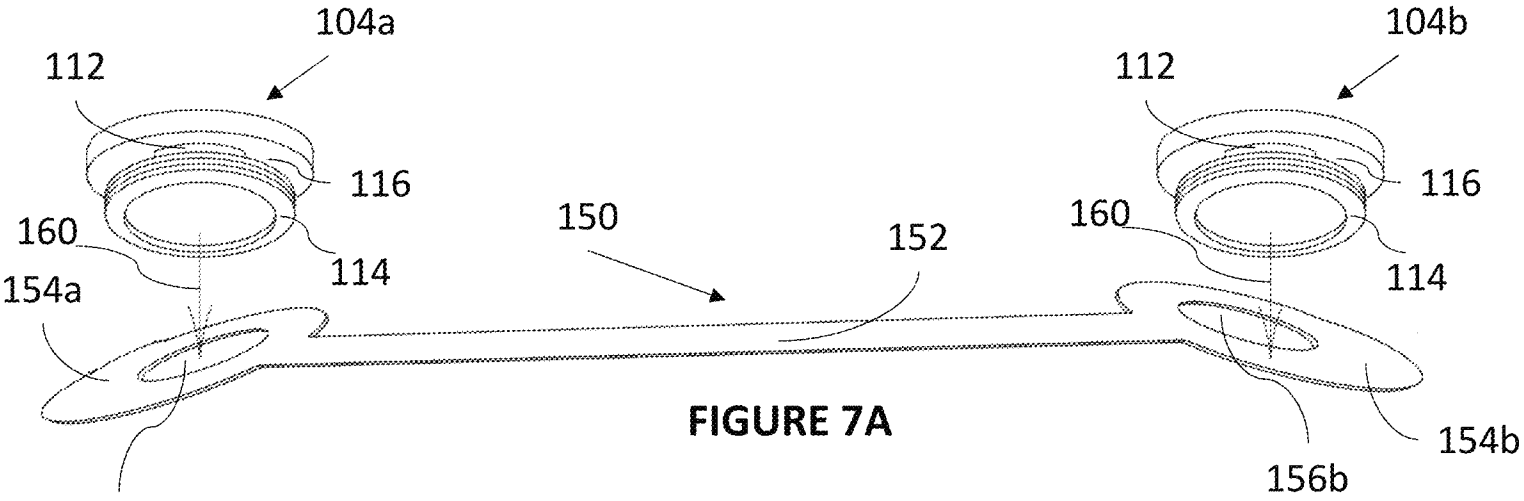
FIGS. 7A and 7B are, respectively, an exploded view illustration and a perspective view illustration of the tether of FIG. 5, connected to two upper covers of the canister of FIG. 1, to form part of a fidget toy according to some embodiments of the disclosed technology.
Figure 7B:
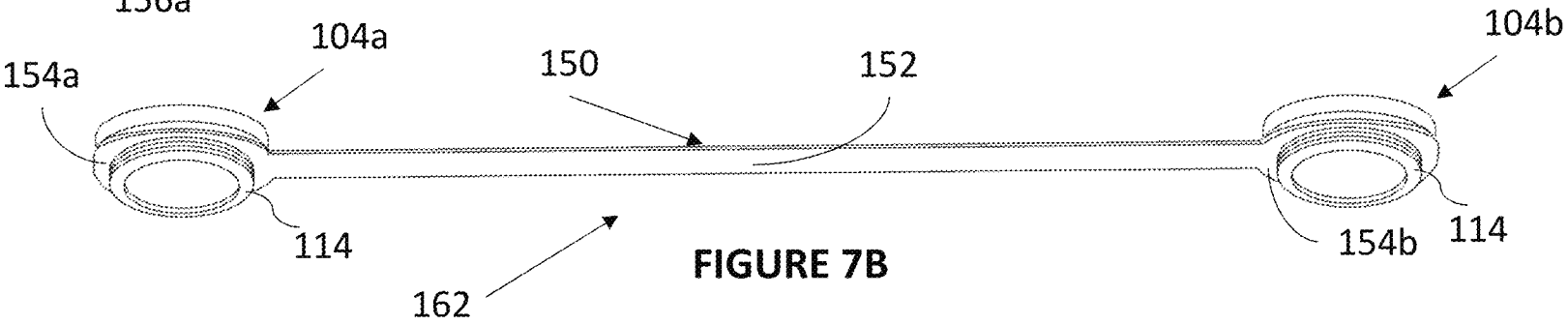

FIGS. 7A and 7B are, respectively, an exploded view illustration and a perspective view illustration of tether 150, connected to two upper covers 104*a* and 104 of canisters as shown in FIGS. 4A and 4B, to form part of a fidget toy according to some embodiments of the disclosed technology. As seen, loops 154*a* and 154*b* of tether 150 are pushed in the direction of arrows 160, such that one loop 154*a* of tether 150 is disposed about neck portion 112 of first upper cover 104*a*, another loop 154*b* of tether 150 is disposed about neck portion 112 of second upper cover 104*b*, and central line 152 connects the two upper covers. In this arrangement, loops 154 of tether 150 are each within a recess 116 of a different one of the upper covers. As such, tether 150 is directly attached to upper covers 104*a* and 104*b*, forming an assembly indicated by reference numeral 162. However, in some embodiments, sizing of central openings 156*a* and 156*b* is such that the tether 150 can rotate about the neck portions of upper covers 104*a* and 104*b*, and thus can rotate relative to the upper covers. It is to be appreciated that, in order to place loops 154*a* and 154*b* around the neck portions of upper covers 104*a* and 104*b*, the loops of the tether are stretched and manipulated so that openings 156 (FIG. 5) are sufficiently large for engagement portions 114 of upper covers 104*a* and 104*b* to pass through the openings. The resilience and/or elasticity of the tether ensure that, once the engagement portions pass through the openings and tether 150 is released, the tether and openings return to their original dimensions and/or configuration.

Figure 8A:
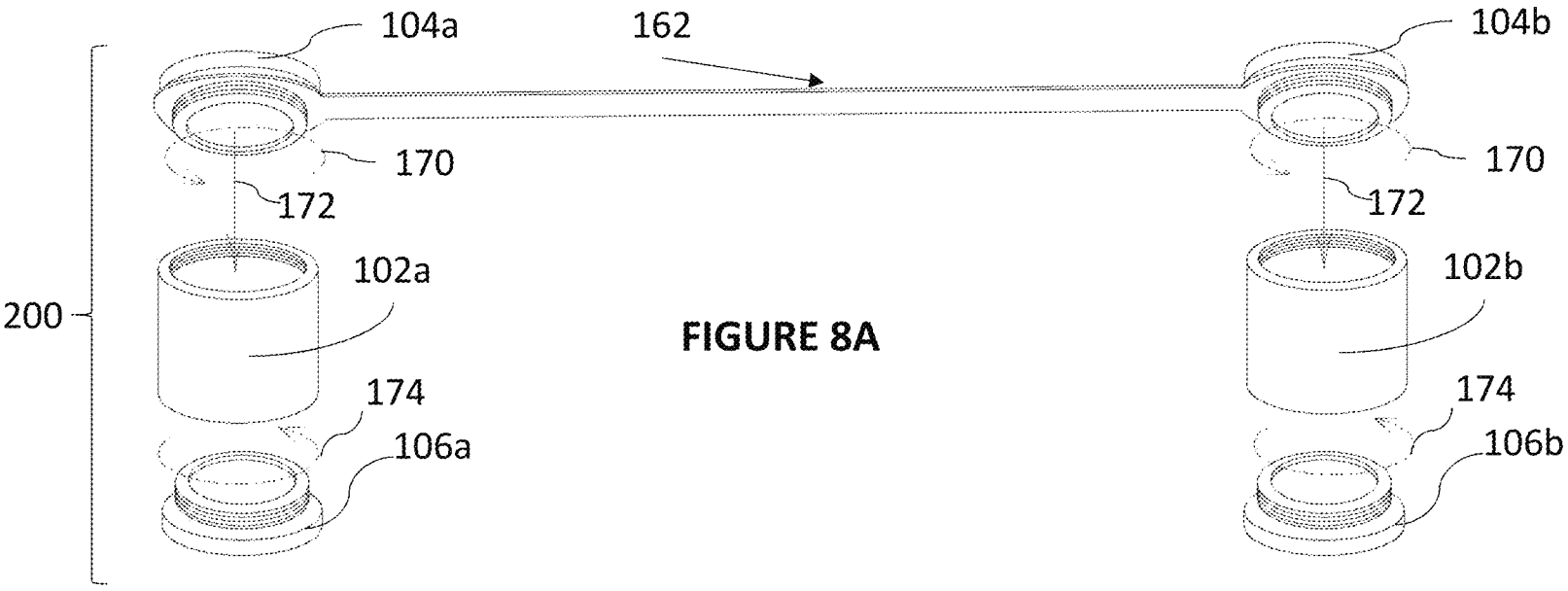
FIGS. 8A and 8B are, respectively, an exploded view illustration and a perspective view illustration of a fidget toy including the tether of FIG. 5 and two canisters of FIG. 1, according to some embodiments of the disclosed technology.
Figure 8B:
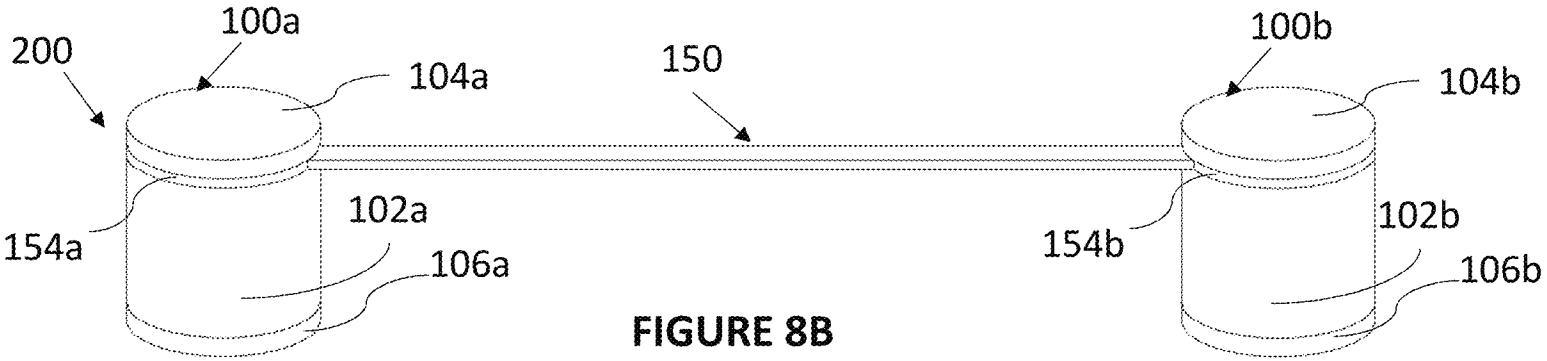

Reference is now made to FIGS. 8A and 8B which are, respectively, an exploded view illustration and a perspective view illustration of a fidget toy including assembly 162 (FIG. 7B) and canisters 100*a* and 100*b* (FIG. 1), according to some embodiments of the disclosed technology.

As seen, a user twists hollow body portion 102*a* of canister 100*a* onto upper cover 104*a*, which forms part of assembly 162. Similarly, the user twists hollow body portion 102*b* of canister 100*b* onto upper cover 104*b*, which forms part of assembly 162. The twisting of the hollow body portions onto the upper covers is in the direction of arrows 170, such that the assembly 162 is moved toward body portions 102*a* and 102*b* in the direction of arrows 172.

The user also twists lower cover 106*a* onto body portion 102*a* of canister 100*a*, and twists lower cover 106*b* onto body portion 102*b* of canister 100*b*, in the direction of arrows 174. The resulting structure, which includes two complete canisters 100*a* and 100*b* connected by tether 150, forms fidget toy 200.

It is to be appreciated that there is no significance to the order in which the components of fidget toy 200 are connected to each other. For example, the user may connect upper cover 104*a* to tether 150, and the proceed to connect the remaining components of canister 100*a*, followed by connection of the components of canister 100*b*. As another example, the user may form assembly 162, then connect the two hollow bodies, and subsequently connect the two lower covers to the toy being formed.

As seen, within toy 200, tether 150 extends between the pairs of upper covers (104*a*, 104*b*) and corresponding hollow bodies (102*a*, 102*b*), such that the two canisters are rotatable relative to the tether.

Figure 9B:
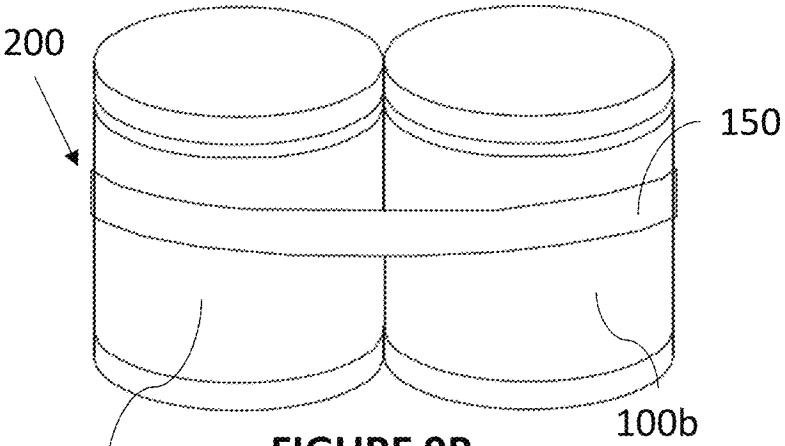
FIGS. 9A, 9B, and 9C are perspective view illustration of various configurations of the fidget toy of FIGS. 8A and 8B, which configurations can be accomplished during fidgeting with the fidget toy.
Figure 9C:
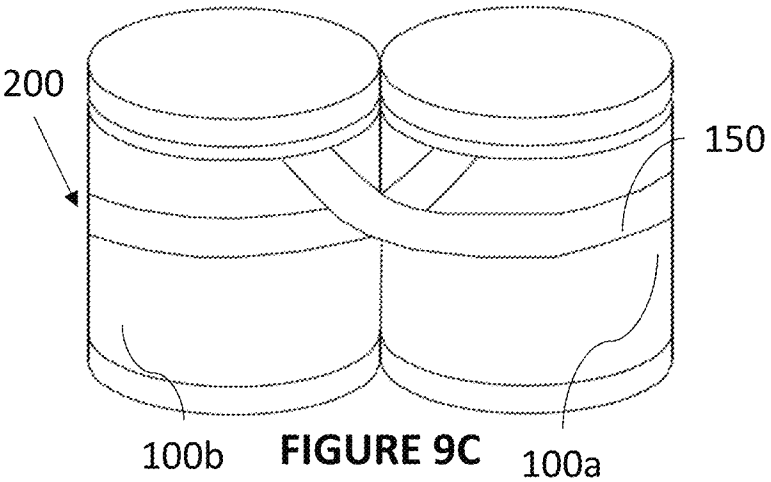
Figure 9A:
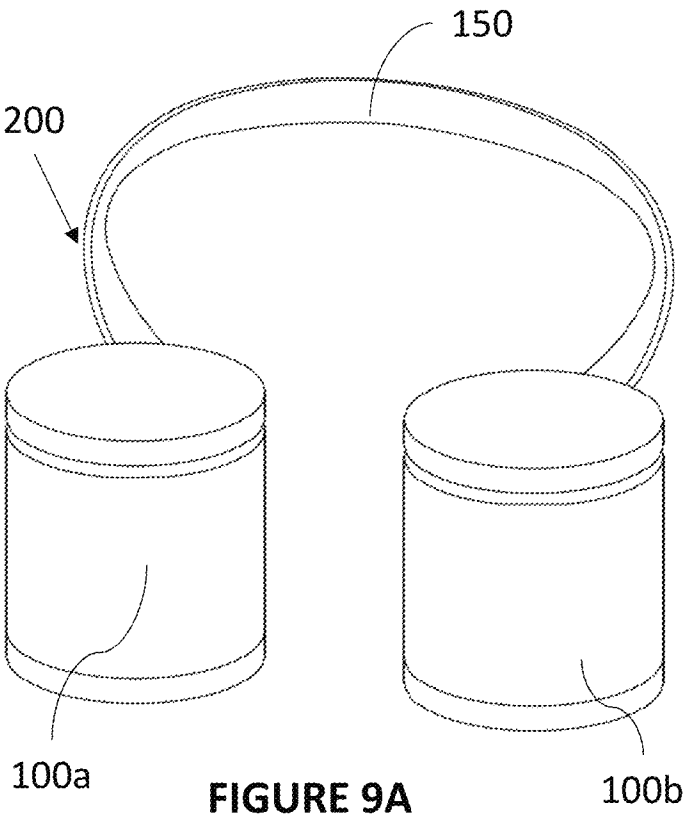

Reference is now additionally made to FIGS. 9A, 9B, and 9C, which are perspective view illustration of various configurations of fidget toy 200, which configurations can be assumed during fidgeting with the fidget toy or during storage thereof.

As seen in FIG. 9A, tether 150 may be bent, or twisted, relative to canisters 100*a* and 100*b*, thereby to change the distance between the canisters.

In FIGS. 9B and 9C, the canisters 100*a* and 100*b* are placed adjacent one another, such that tether 150 wraps around the canisters. FIG. 9B illustrates one side of the configuration, in which tether 150 extends straight across the canisters, while FIG. 9C shows the opposing side of the configuration, with portions of tether 150 crossing over each other. In the configuration of FIGS. 9B and 9C, tether 150 holds canisters together, and thus this configuration is suitable for storage of fidget toy 200.

Fidget toy 200 may be used in a variety of ways. A primary use may be for fidgeting, by rotating canisters 100*a* and 100*b* relative to tether 150, twisting the tether, opening and closing the canisters, and the like. Slinging motion of fidget toy 200 is fun, and may improve brain function, focus, patience, and hand-eye coordination. Playing with fidget toy 200 may also reduce stress and relieve anxiety. Similarly, playing with fidget toy 200 may occupy the hands and mind, thus assisting in breaking bad habits such as smoking, nail biting, and the like.

Fidget toy 200 may be used as a massage device, for example to massage the arms, neck, and back. In some such applications, one or both of canisters 100 may include a vibrating motor, e.g. a pressure activated vibration motor, which may add a vibrational component to the massage capacity of the fidget toy. In some applications, fidget toy 200 may be used to stimulate acupuncture points in the human body, for example on the head, hands, arms, and neck of a user. In some applications, fidget toy 200 may be used as a meditation device, for example when used in a repetitive manner. Use of fidget toy 200 in both hands may assist in building ambidextrous skills.

Canisters 100*a* and 100*b* may be used as storage containers, for example for storing medications or smoking implements. Canisters 100*a* and 100*b* may also be used to store small items, such as earbuds, jewelry, and the like. The canisters may also store liquids or creams, such as liquor, sanitizer, face cream, lip balm, and the like. As another example, canisters 100*a* and 100*b* may be filled with water, or another liquid, frozen, and then used as an ice pack.

In some applications, canisters 100*a* and 100*b* may be used as shot glasses, for example when disconnected from upper covers 104*a* and 104*b*, respectively. Similarly, canisters 100*a* and 100*b* may be used as measuring cups or spoons, for measuring powders (e.g. sugar, salt, pepper) or liquids (e.g. hot sauce). For example, a canister 100*a* may have a volume of a 15 ml, or a tablespoon, for measurement.

In some applications, one or both of canisters 100*a* and 100*b* may include, or be, a portable electronic device. For example, canister 100*a* may include, or be, a USB flash drive. As another example, canister 100*a* may include, or be, a charging bank for charging other electronic devices. In such embodiments, opening of lower cover 106*a* may reveal an electronic connection, such as a C-type connector or a USB connector.

In some applications, one or both of canisters 100*a* and 100*b* may include, or be, an LED light, a pen, and/or a stylus. In some applications, one or both of canisters 100*a* and 100*b* may include, or be, a lighter, such as a Zippo® style lighter.

In some applications, one or both of canisters 100*a* and 100*b* may include or form a survival kit. For example, canisters 100*a* and 100*b* may include a compass, a Fire-starter, and a whistle. As another example, canisters 100*a* and 100*b* may include a knife and/or a grinder.

In some applications, fidget toy 200 may include branding information—for example printed onto tether 150 or onto one or more exterior surfaces of canisters 100*a* and/or 100*b*. For example, fidget toy 200 may include branding information and may be provided as advertising merchandise, for example at professional conferences. As another example, fidget toys 200 may have different series of images and brands, to form collectible items, in a similar manner to the collectible nature of Pez® dispensers. In this capacity, fidget toys 200 may also form licensable and tradable items.

In some applications, fidget toy 200 may be used as a self-defense weapon. For example, the fidget toy may function as a slingshot, with tether 150 being sufficiently elastic to sling a projectile. As another example, one or both of canisters 100 may be equipped with protruding spikes, thus enabling the user to use the fidget toy as a form of Morningstar. Similarly, fidget toy 200 may be used as nunchucks, if canisters 100*a* and 100*b* are sufficiently heavy. Additionally, when clenched in a user's fist, the fidget toy 200 may serve to reinforce the fist, and strengthen punches applied by the fist.

Fidget toy 200 may also have many practical applications. For example, the fidget toy may be used as a musical percussion instrument, by hitting different surfaces with canisters 100*a* and 100*b*. The canisters and tether may be arranged on a table so as to form a phone stand, for example in an arrangement similar to that shown in FIG. 9A. When separated from canisters 100*a* and 100*b* (e.g. as shown in FIG. 5), tether 150 may be used as a carabiner to form a hanging device or tie, onto which other items, such as glasses, purses, and the like may be tied. Similarly, fidget toy 200 may be connected to a bag or pocket, to form an extension thereof and to facilitate hanging of additional items from the bag or pocket.

In some applications, such as in an office setting, fidget toy 200 may be used as a pendulum, or a desktop weight. In some applications, fidget toy 200 may be used as a drawing aid—for example by using tether 150 as a ruler, or by using canisters 100*a* and 100*b* to draw circles. Fidget toy 200 may also be used as a safety device, for example for breaking glass in an emergency, provided that canisters 100*a* and 100*b* are sufficiently strong and/or heavy.

Fidget toy 200 may also be used as a game. For example, the challenge may be to sling the toy such that one canister settles above the other canister. As another example, the fidget toy may be used for magnetic table top scoring, or as a magnetic device for playing. Further, multiple fidget toys may be used to stack on one another, and build various structures. Finally, the fidget toy may be used as a ball for board top sport games, or as a net or goal for various table top or board top sports games. For example, the fidget toy may be placed on the table to form a goal for table soccer or hockey, or the canisters 100*a* and 100*b* may be opened to form "baskets" for tabletop basketball using a small ball or marble.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

I claim:

1. A toy comprising:

at least one canister including an upper cover and a cylindrical body; and a tether, including an elongate central line and a pair of loops at ends of the line, at least one of the loops being disposed about the upper cover of the at least one canister;

wherein the at least one canister comprises a single canister, and wherein both loops of the pair are disposed about the upper cover of the single canister.

2. A toy comprising:

at least one canister including an upper cover and a cylindrical body; and a tether, including an elongate central line and a pair of loops at ends of the line, at least one of the loops being disposed about the upper cover of the at least one canister;

wherein the at least one canister further comprises a lower cover, removably attached to the cylindrical body.

3. The toy of claim 2, further comprising a magnet disposed within the lower cover.

4. The toy of claim 2, wherein the lower cover is threadably attached to the cylindrical body.

5. A toy comprising:

at least one canister including an upper cover and a cylindrical body;

a tether, including an elongate central line and a pair of loops at ends of the line, at least one of the loops being disposed about the upper cover of the at least one canister;

a magnet disposed within the upper cover.

6. A toy comprising:

at least one canister including an upper cover and a cylindrical body; and a tether, including an elongate central line and a pair of loops at ends of the line, at least one of the loops being disposed about the upper cover of the at least one canister;

wherein the canister comprises an electronic storage device.

7. A toy comprising:

at least one canister including an upper cover and a cylindrical body; and a tether, including an elongate central line and a pair of loops at ends of the line, at least one of the loops being disposed about the upper cover of the at least one canister;

wherein the tether is elastic, such that the toy functions as a sling-shot.

8. A method of constructing a toy, the method comprising:

obtaining a tether, including an elongate central line and a pair of loops at ends of the line;

placing at least one of the loops about an upper cover; and attaching a cylindrical body to the upper cover, to form at least one canister, wherein the at least one of the loops is disposed between the upper cover and the cylindrical body, and is rotatable relative to the upper cover and relative to the cylindrical body; and wherein the placing of the at least one of the loops comprises placing both loops of the pair of loops about the upper cover.

9. A method of constructing a toy, the method comprising:

obtaining a tether, including an elongate central line and a pair of loops at ends of the line;

placing at least one of the loops about an upper cover;

attaching a cylindrical body to the upper cover, to form at least one canister, wherein the at least one of the loops is disposed between the upper cover and the cylindrical body, and is rotatable relative to the upper cover and relative to the cylindrical body; and attaching a lower cover to an end of the cylindrical body.

10. A method of constructing a toy, the method comprising:

obtaining a tether, including an elongate central line and a pair of loops at ends of the line;

placing a first loop of the pair of loops about a first upper cover, and placing a second loop of the pair of loops about a second upper cover; and attaching a first cylindrical body to the first upper cover and attaching a second cylindrical body to the second upper cover, the form first and second canisters; and attaching a first lower cover to an end of the first cylindrical body and attaching a second lower cover to an end of the second cylindrical body; and wherein the at least one of the loops is disposed between the upper cover and the cylindrical body, and is rotatable relative to the upper cover and relative to the cylindrical body.

* * * * *